US010648286B2

(12) United States Patent
Gao et al.

(10) Patent No.: US 10,648,286 B2
(45) Date of Patent: May 12, 2020

(54) METHODS FOR CEMENTING A WELL USING A SWITCHABLE CROSSOVER DEVICE

(71) Applicant: Halliburton Energy Services, Inc., Houston, TX (US)

(72) Inventors: Bo Gao, Spring, TX (US); Lonnie Carl Helms, Humble, TX (US); Aniruddha Gadre, The Woodlands, TX (US); Yuzhu Hu, Spring, TX (US); Gary Makowiecki, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/318,697

(22) PCT Filed: Sep. 23, 2016

(86) PCT No.: PCT/US2016/053540
§ 371 (c)(1),
(2) Date: Jan. 17, 2019

(87) PCT Pub. No.: WO2018/057011
PCT Pub. Date: Mar. 29, 2018

(65) Prior Publication Data

US 2019/0284903 A1 Sep. 19, 2019

(51) Int. Cl.
*E21B 33/14* (2006.01)
*E21B 34/06* (2006.01)
(Continued)

(52) U.S. Cl.
CPC ..... *E21B 34/10* (2013.01); *E21B 33/14* (2013.01); *E21B 33/16* (2013.01); *E21B 34/06* (2013.01);
(Continued)

(58) Field of Classification Search
CPC ..... E21B 33/14; E21B 34/063; E21B 43/116; E21B 43/045; E21B 43/10; E21B 17/02; E21B 2034/007
See application file for complete search history.

(56) References Cited

U.S. PATENT DOCUMENTS 7,857,052 B2 12/2010 Giroux et al.
8,695,709 B2 4/2014 Zimmerman et al.
(Continued)

FOREIGN PATENT DOCUMENTS

WO 0308099 10/2003
WO 2015038119 3/2015
WO 2015038171 3/2015

OTHER PUBLICATIONS

International Search Report and Written Opinion of PCT Application No. PCT/US2016/053540 dated Jun. 19, 2017: pp. 1-19.

*Primary Examiner* — Zakiya W Bates
(74) *Attorney, Agent, or Firm* — Chamberlain Hrdlicka

(57) ABSTRACT

Switchable cross-over systems, devices, and methods for cementing well walls. A switchable cross-over device includes a tool body, a flow sleeve, and a hydraulic sleeve. The tool body includes a main tool path separable into upper and lower tool paths and an auxiliary chamber containing upper and lower annular ports. The flow sleeve is within the auxiliary chamber and movable into a reverse circulation position by a plug traveling through the main tool path. The hydraulic sleeve is located within the main tool path and mechanically coupled to the flow sleeve. The hydraulic sleeve is movable into a conventional circulation position via pressure within the main tool path acting on the hydraulic sleeve.

16 Claims, 9 Drawing Sheets

(51) Int. Cl.

| | |
|---|---|
| ***E21B 34/10*** | (2006.01) |
| ***E21B 43/10*** | (2006.01) |
| ***E21B 33/16*** | (2006.01) |
| *E21B 34/00* | (2006.01) |

(52) U.S. Cl.
CPC ..... *E21B 34/063* (2013.01); *E21B 2034/007* (2013.01)

(56) References Cited

U.S. PATENT DOCUMENTS

| | | | |
|---|---|---|---|
| 2003/0192694 | A1 | 10/2003 | Zachman et al. |
| 2005/0103495 | A1 | 5/2005 | Corbett |
| 2010/0218948 | A1 | 9/2010 | Mickelburgh et al. |
| 2012/0048562 | A1 | 3/2012 | Zimmerman et al. |
| 2014/0305662 | A1 | 10/2014 | Giroux et al. |

METHODS FOR CEMENTING A WELL USING A SWITCHABLE CROSSOVER DEVICE

This section is intended to provide relevant contextual information to facilitate a better understanding of the various aspects of the described embodiments. Accordingly, it should be understood that these statements are to be read in this light and not as admissions of prior art.

In cementing operations carried out in oil and gas wells, a hydraulic cement composition is disposed between the walls of the wellbore and the exterior of a pipe string, such as a casing string, that is positioned within the wellbore. The cement composition is permitted to set in the annulus thereby forming an annular sheath of hardened, substantially impermeable cement therein. The cement sheath physically supports and positions the pipe in the wellbore and bonds the pipe to the walls of the wellbore whereby the migration of fluids between zones or formations penetrated by the wellbore is prevented.

A conventional method of cementing involves pumping the cement composition down through the casing and then up through the annulus. In this method, the volume of cement required to fill the annulus must be calculated. Once the calculated volume of cement has been pumped into the casing, a cement plug is placed in the casing. A drilling mud is then pumped behind the cement plug such that the cement is forced into and up the annulus from the far end of the casing string to the surface or other desired depth. When the cement plug reaches a landing collar, float collar, or float shoe disposed proximate the far end of the casing, the cement should have filled the entire volume of the annulus. At this point, the cement is allowed to cure in the annulus into the hard, substantially impermeable mass.

This method, however, may not be suitable for all wells, as it requires the cement to be pumped at high pressures, which makes it potentially unsuitable for wells with softer formations or formations prone to fracture. Reverse cementing is an alternative cementing method in which the cement composition is pumped directly into the annulus between the casing string and the wellbore. Using this approach, the pressure required to pump the cement to the far end of the annulus is much lower than that required in conventional cementing operations. Liner casing does not extend all the way to the wellhead. Rather, liner casing is typically suspended from the bottom of an upper casing segment, requiring a liner hanger. Thus, reverse cementing of the liner casing often requires crossover cementing, in which cement is delivered downhole through a conveyance such as a drill pipe, and then crossed over into the annulus between the liner casing and the wellbore.

BRIEF DESCRIPTION OF THE DRAWINGS

For a detailed description of the embodiments of the invention, reference will now be made to the accompanying drawings in which.

DETAILED DESCRIPTION

The present disclosure provides a cross-over tool for enabling reverse circulation cementing in a well with liner casing. The cross-over tool is switchable between conventional circulation and reverse circulation as needed to accommodate different stages of the cementing operation. Although the present disclosure uses a cementing operation to illustrate an application of the crossover tool, the cross-over tool can also be used in a variety of other operations in which a material is to be placed downhole or used to displace another material.

Figure 1:
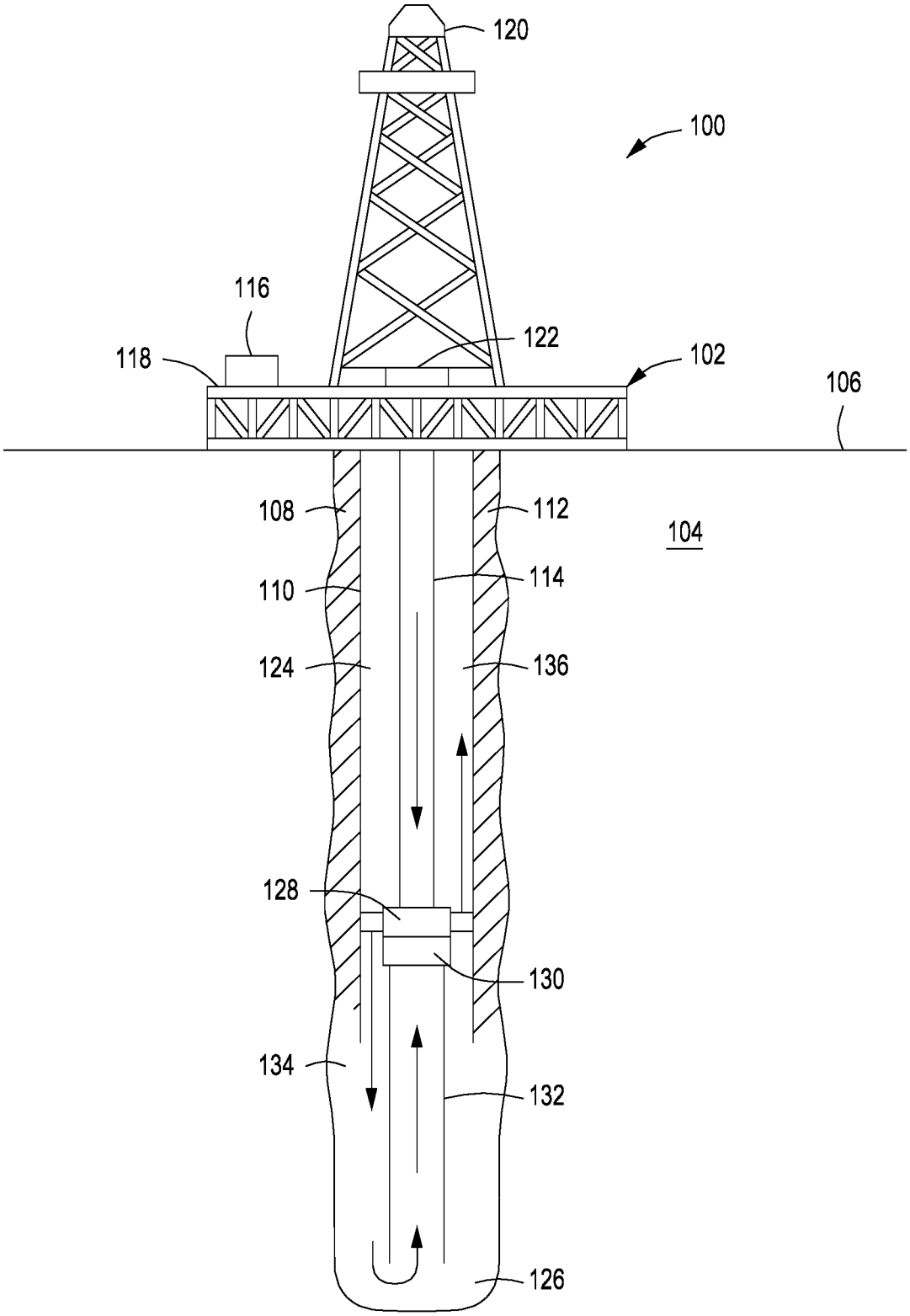
FIG. 1 is a schematic view of a well system with liner casing undergoing reverse circulation cementing using a cross-over tool in a reverse circulation mode, in accordance with one or more embodiments.

Referring to the drawings, FIG. 1 depicts a well system 100 with liner casing 132 undergoing reverse circulation using a crossover tool 128, in accordance with one or more embodiments. The system 100 includes a rig 102 over a subterranean oil or gas formation 104 located below the earth's surface 106. A wellbore 108 extends through the various earth strata including formation 104. An upper casing string 110 is located in the wellbore 108 and an annulus 112 is formed between the upper casing string 110 and the wellbore 108. The rig 102 includes a work deck 118 that supports a derrick 120. The derrick 120 supports a hoisting apparatus 122 for raising and lowering pipe strings such as the upper casing string 110. A pump 116 may be located on the work deck 118 and is capable of pumping a variety of fluids, such as cementing material, into the well. The pump 116 may include a pressure sensing means that provides a reading of back pressure at the pump discharge.

A liner casing 132 is suspended within the wellbore 108 extending further downhole from the upper casing string 110. The liner casing 132 is coupled to a liner hanger 130, which is coupled to the crossover tool 128. During a reverse circulation cementing operation, the liner casing 132, the liner hanger 130, and the crossover tool 128 are all suspended from a pipe 114, such as drill pipe, which extends to the surface 106. In one or more embodiments, the liner casing 132 and/or liner hanger 130 may be set to the upper casing string 110 and is at least partially suspended by the upper casing string 110. The crossover tool 128 is configured to separate and direct downhole and uphole flow. Specifically, the crossover tool 128 is switchable between enabling reverse circulation and enabling conventional circulation flow through the wellbore 108.

In one or more embodiments, the upper casing string 110 is cemented prior to cementing the liner casing 132, through conventional or reverse cementing techniques. In certain such embodiments, the wellbore is drilled deeper after cementing the upper casing string 110. The liner casing 132 is then positioned in the additionally formed well depth and cemented via reverse cementing. FIG. 1 illustrates the crossover tool 128 in a reverse circulation mode. As illustrated in FIG. 1, during a reverse cementing operation for cementing the liner casing 132, a cementing material is pumped, via the pump 116 located at the surface 106, into the pipe 114. The cementing material travels downhole through the pipe 114 into the crossover tool 128. The cementing material is then directed out of the crossover tool 128 and continues downhole, filling a lower annulus 134 between the liner casing 132 and the wellbore 108 towards well bottom 126, thereby cementing the annulus 134. The fluid return path is uphole through the inside of the liner casing 132, through the liner hanger 130 and into the crossover tool 128. The crossover tool 128 directs the uphole flow into an upper annulus 136 between the pipe 114 and the upper casing string 110 and to the surface 106. The upper annulus 136 between the pipe 114 and the upper casing string 110 is separated from the annulus 134 between the liner casing 132 and the wellbore 108 by the crossover tool 128. The crossover tool 128 provides an internal downhole flow path that couples the pipe 114 and the annulus 134 between the liner casing 132 and the wellbore 108. The crossover tool 128 further provides a separate internal uphole flow path that couples the inside of the liner casing 132 and the upper annulus 136 between the pipe 114 and the upper casing string 110.

The wellbore 108 may be filled with various fluids such as drilling fluid which may be displaced uphole through the uphole return path. Drilling fluid has a different density profile than cementing material. Specifically, drilling fluid typically has a lower density than cementing material. Drilling fluid may be any typical drilling fluid such as a water-based or oil-based drilling fluid. The cementing material used may be or include any typical hydraulic cementitious material that includes calcium, aluminum, silicon, oxygen, sulfur, and/or any mixture thereof and can set and harden by reaction with water. Exemplary hydraulic cementitious materials may be or include, but are not limited to, one or more Portland cements, one or more pozzolana cements, one or more gypsum cements, one or more alumina cements (e.g., high aluminum content cement), one or more silica cements, one or more high alkalinity cements (e.g., pH of about 12 to about 14), one or more resins, or any mixture thereof. In some embodiments, one or more resins may be used in place of cement or in combination with cement.

Figure 2:
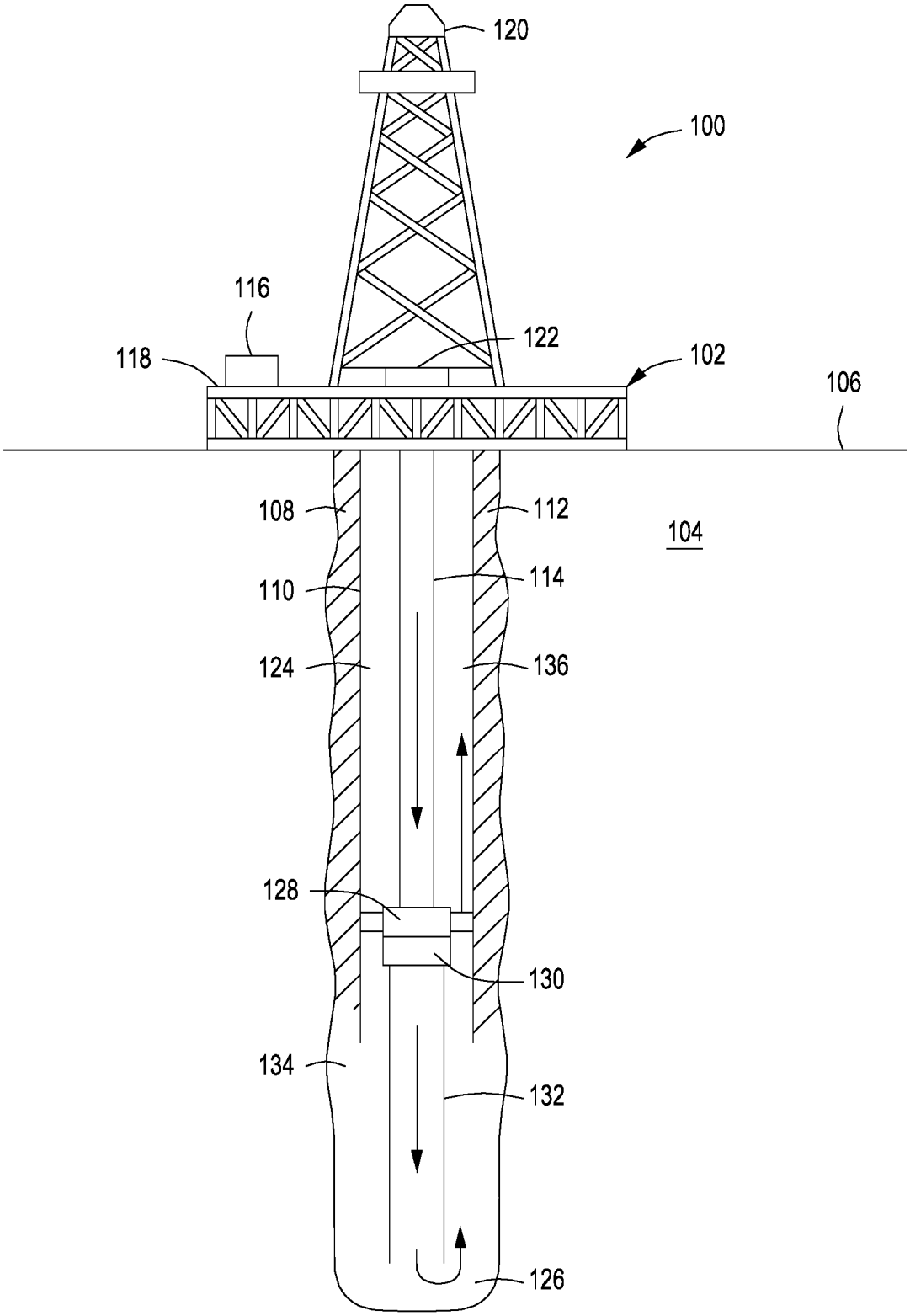
FIG. 2 is a schematic view of the well system with the cross-over tool in a conventional circulation mode, in accordance with one or more embodiments.

The crossover tool 128 is switchable between a reverse circulation mode, as illustrated in FIG. 1, and a conventional circulation mode, as illustrated in FIG. 2. Referring to FIG. 2, in the conventional circulation mode, downhole flow is directed downhole through the pipe 114 and through the inside of the liner casing 132 towards the well bottom 126, and which point flow is directed uphole through the annulus 134 between the liner casing 132 and the wellbore 108 and further uphole through the annulus between the upper casing string 110 and the pipe 114 to the surface 106. The crossover tool 128 can be switched back and forth between the conventional circulation mode and the reverse circulation mode multiple times as needed.

Figure 3:
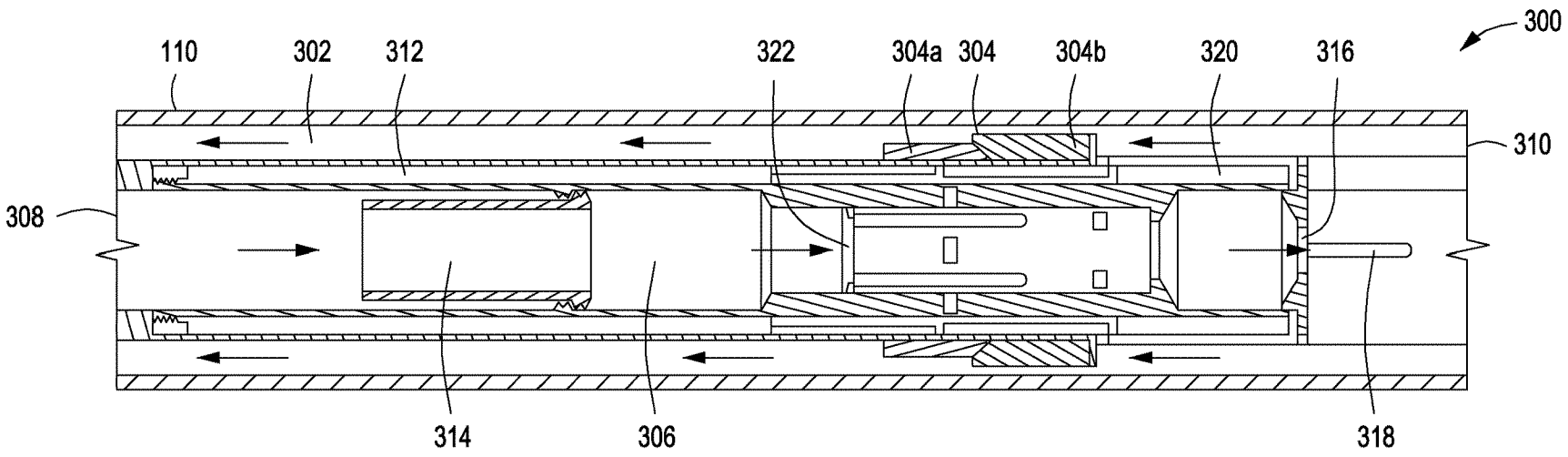
FIG. 3 is a cross-sectional view of an embodiment of a cross-over tool in an initial run-in state, in accordance with one or more embodiments.

FIG. 3 illustrates an embodiment of a cross-over tool 300, such as cross-over tool 128, in an initial run-in state. The tool 300 is run downhole into the upper casing string 110 in such a state. The tool 300 includes a body 302 having an uphole end 308 and a downhole end 310. The uphole end 308 may be coupled to a conveyance such as the pipe 114 (FIG. 1). The downhole end 310 may be coupled to the liner casing 132 via a liner hanger 130 (FIG. 1).

The tool body 302 defines a main tool path 306 through the cross-over tool 300. The cross-over tool 300 also includes an external packer 304 located on the outside of the cross-over tool 300. As shown, the external packer 304 is in an unactuated position when the cross-over tool 300 is in the initial run-in state in which a packer sleeve 304*a* is disengaged from a packer body 304*b*, leaving a space between the packer 304 and the upper casing string 110 permitting fluid flow therethrough. The packer 304 is mechanically coupled to a packer slider 316 located within the main tool path 306 and retained within one or more slots 318 such that moving the packer slider 316 along the slots 318 actuates the packer 304, as further discussed below.

The tool body 302 further includes an auxiliary chamber 320 in which a flow sleeve 312 is located. The flow sleeve 312 is movable with respect to the tool body 302 to switch the cross-over tool 300 between a conventional circulation mode and a reverse circulation mode. The flow sleeve 312 is mechanically coupled to and movable via a flow sleeve slider 322 located within the main tool path 306. Specifically, the flow sleeve 312 can be moved into the reverse circulation mode by moving the flow sleeve slider 322. The flow sleeve 312 is further mechanically coupled to a hydraulic sleeve 314 located inside the main tool path 306. The flow sleeve 312 is moveable from the reverse circulation mode to the conventional circulation mode by moving the hydraulic sleeve 314.

Figure 4:
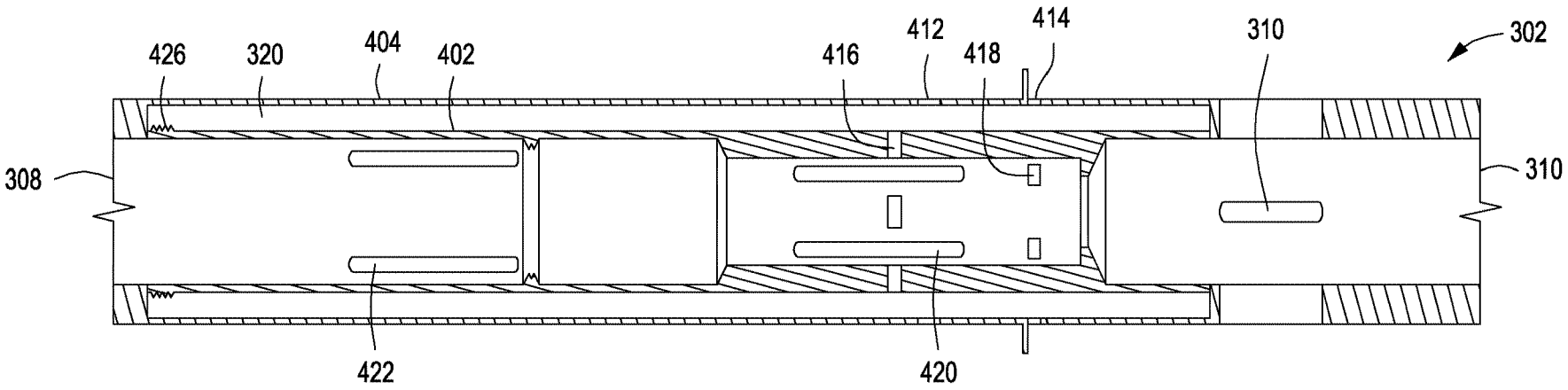
FIG. 4 is a cross-sectional view of a tool body of the cross-over tool, in accordance with one or more embodiments.

FIG. 4 depicts a cross-sectional view of the tool body 302 alone, in accordance with one or more embodiments. The tool body 302 includes an inner wall 402 and an outer wall 404 between which the auxiliary chamber 320. The inner wall 402 defines the main tool path 306 through the switchable cross-over device 300. The tool body 302 further includes one or more uphole annulus ports 412 and one or more downhole annulus ports 414 formed in the outer wall 404, and one or more uphole tool ports 416 and one or more downhole tool ports 418 formed in the inner wall 402. The ports 412, 414 in the outer wall 404 open to outside of the tool body 302, such as into the annulus 134 or 136 and the ports 416, 418 in the inner wall 402 open to the main tool path 306. The inner wall 402 of the tool body 302 further includes a flow sleeve slot 420 formed in an axial direction through which the flow sleeve 312 is coupled to the flow sleeve slider 322 (FIG. 3) and to provide a guide for sliding the flow sleeve 312. The tool housing 302 also includes hydraulic sleeve slots 422 through which the flow sleeve 312 couples to the hydraulic sleeve 314. The tool housing 302 further includes a coupling feature 426 located at an uphole end of the auxiliary chamber 320 configured to hold the flow sleeve 312 until the flow sleeve 312 is pulled downward.

Figure 5:
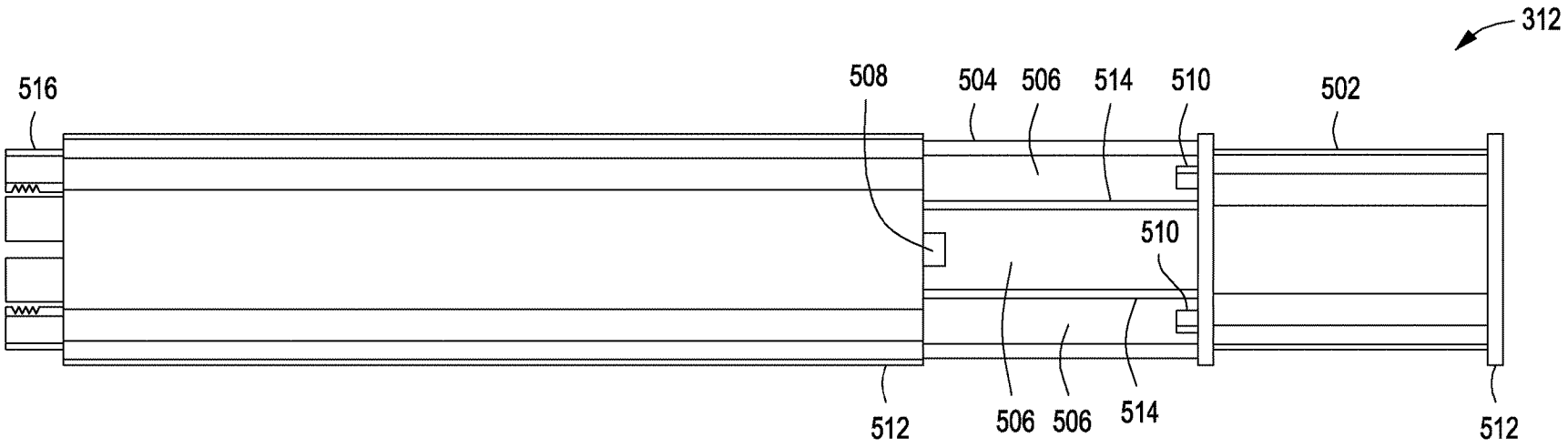
FIG. 5 is a side view of a flow sleeve of the cross-over tool, in accordance with one or more embodiments.

FIG. 5 illustrates a side view of the flow sleeve 312, in accordance with one or more embodiments. The flow sleeve 312 includes an open portion 502 and a segmented portion 504. Each portion 502 is defined between raised barriers 512 to isolate the open portion 502 from the segmented portion 504 when located within the auxiliary chamber 320. The segmented portion 504 is further partitioned into compartments 506 by raised barriers 514 which isolate the compartments 506 when located within the auxiliary chamber 320, thereby separating the auxiliary chamber 320 into at least a first auxiliary path and a second auxiliary path. At least one of the compartments 506 includes an uphole port 508 and at least one of the compartments 506 includes a downhole port 510. In one or more embodiments, the flow sleeve 312 further includes a latching end 516 configured to latch onto the coupling feature 426 of the tool body 302.

Figure 6:
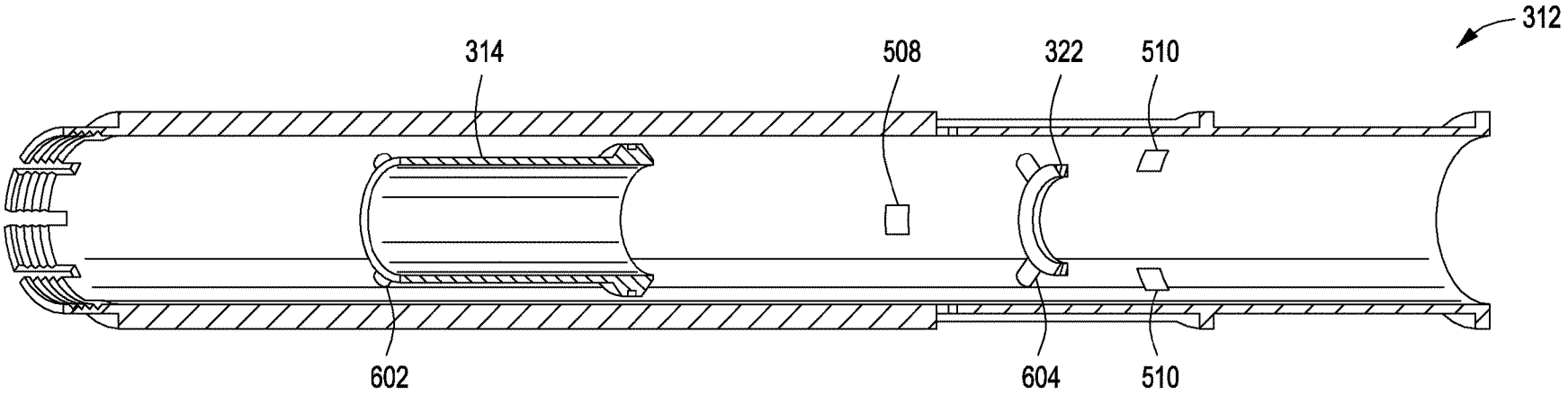
FIG. 6 is a cross-sectional view of the flow sleeve, in accordance with one or more embodiments.

FIG. 6 illustrates a cross-sectional view of the flow sleeve 312, in accordance with one or more embodiments. The flow sleeve 312 is coupled to the hydraulic sleeve 314 via pins 602. The pins 602 are configured to extend through the hydraulic sleeve slots 422 when assembled with the tool body 302, thereby positioning the flow sleeve 312 in the auxiliary chamber 320 and the hydraulic sleeve 314 in the main tool path 306. The flow sleeve slider 322 is also coupled to the flow sleeve 312 via pins 604 that extend through the flow sleeve slot 420, positioning the flow sleeve slider 322 in the main tool path 306.

Figure 7:
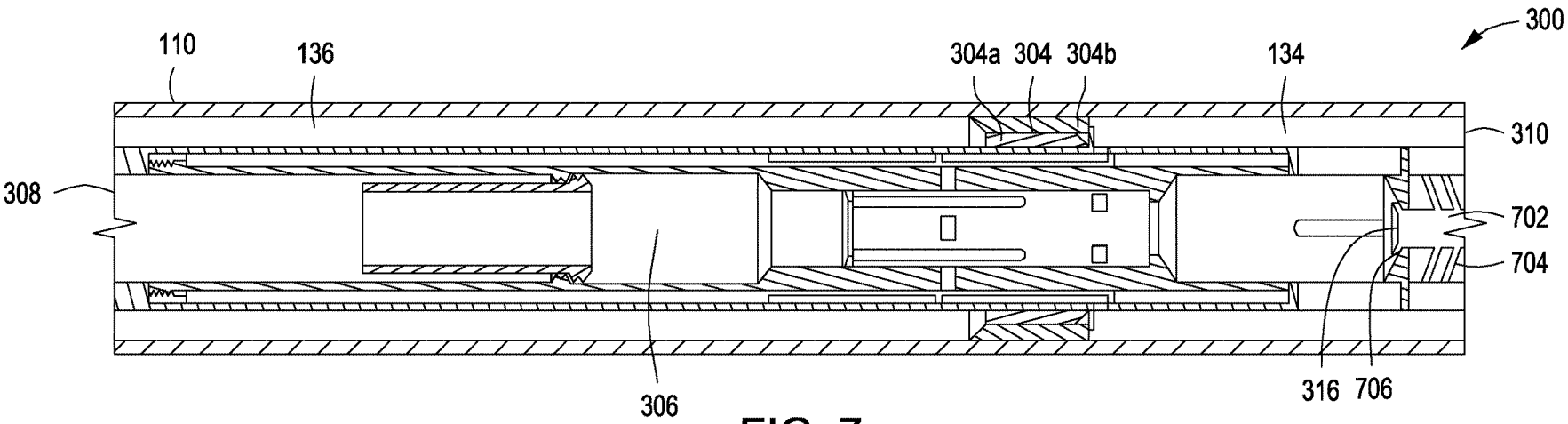
FIG. 7 is a cross-sectional view of the cross-over tool in a conventional circulation mode with an external packer actuated, in accordance with one or more embodiments.

FIG. 7 illustrates the cross-over tool 300 in a conventional circulation mode with the external packer 304 actuated. When the packer is actuated, the packer 304 expands to form a seal between the cross-over tool 300 and the upper casing string 110, thereby separating the upper annulus 136 from the lower annulus 134. In one or more embodiments, the packer 304 is set by pulling the packer sleeve 304*a* downward into the packer body 304*b* to expand the packer body 304*b*. In certain such embodiments, the packer sleeve 304 is mechanically coupled to the packer slider 316 such that when the packer slider 316 is moved towards the downhole end 310, the packer sleeve 304*b* is pulled downward as well, setting the packer 304. In one or more other embodiments, a different type of packer may be used to separate the upper annulus 136 from the lower annulus 134.

The packer slider 316 is located within the main tool path 306 and moved downward by a packer dart 702 travelling downhole through the main tool path 306. In one or more embodiments, the packer slider 316 includes a biasing element such as a surface or protrusion such that the packer dart 702 catches the biasing element as it travels downhole, thereby pulling the slider 316 downward. A pressure is applied to the packer dart 702 from the surface to push it downhole and to move packer slider 316. In one or more embodiments, the packer dart 702 includes a sealing feature 704 which seals against the main tool path 306, enabling the pressure differential needed for the packer dart 702 to push the packer slider 316 downward and set the packer 304. The packer dart 702 may also include an abutment feature 706 such as a dart seat for catching and pulling the packer slider 316 downhole. The packer dart 702 is removed from the main tool path 306 by increasing the pressure uphole of the packer dart 702 which pushes the packer dart 702 downhole, ejecting it from the main tool path 306. In one or more embodiments, the increased pressure causes the packer dart 702 to separate from the abutment feature 706 so that the packer dart 702 is ejected from the main tool path 306, leaving the abutment feature 706 behind on the packer slider 316. The abutment feature 706 includes an orifice such that fluid can still flow through the main tool path 306. Thus, in the conventional circulation mode, the main tool path 306 is open.

Figure 8:
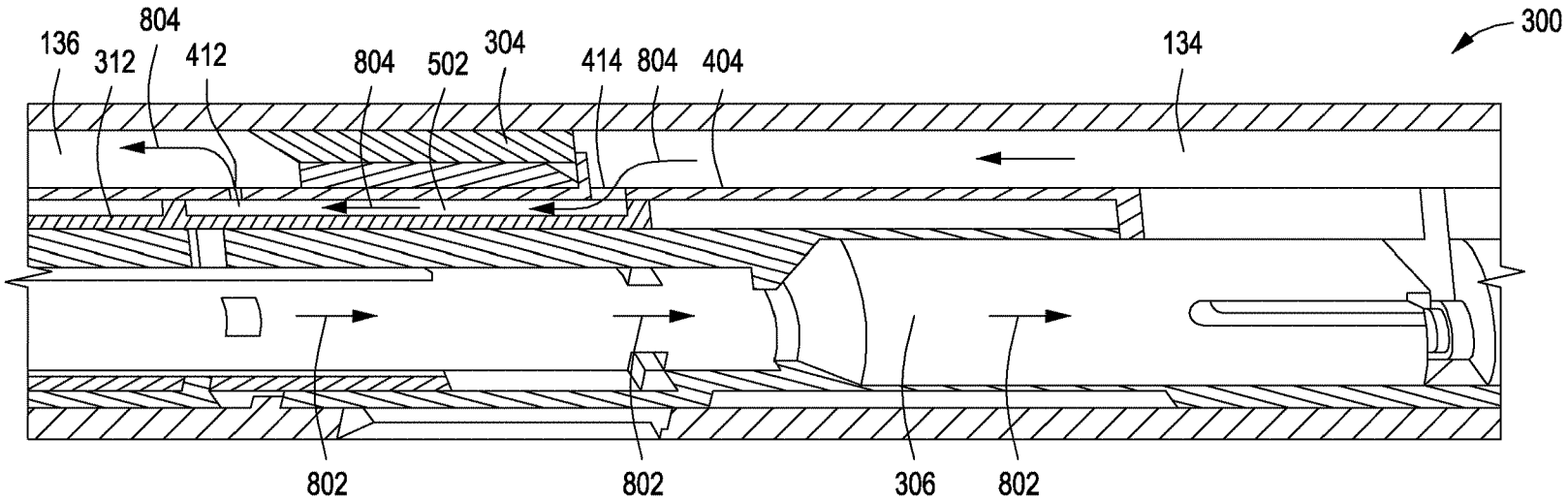
FIG. 8 is a cross-sectional view of the cross-over tool showing the flow path through the cross-over tool during conventional circulation mode, in accordance with one or more embodiments.

FIG. 8 illustrates the flow path through the cross-over tool 300 during conventional circulation mode. In the conventional circulation mode, the flow sleeve 312 is positioned at the uphole end of the auxiliary chamber 320 such that the uphole annulus ports 412 and downhole annulus ports 414 of the outer wall 404 of the tool body 302 are aligned and/or coupled to the open portion 502 of the flow sleeve 312. Arrows 802 indicate the downhole flow path, from the surface to well bottom. Arrows 804 indicate the uphole flow path of returning fluid from well bottom to surface. Downhole flow 802 travels through the main tool path 306. Uphole flow 804, or return flow, travels up the lower annulus 134, into the cross-over tool 300 via the downhole annulus port 414 of the outer wall 404 of the tool body 302, and out of the cross-over tool 300 into the upper annulus 136 via the uphole annulus port 412 of the outer wall 404 of the tool body 302. Thus, the cross-over tool 300 provides an auxiliary path for return fluid to flow up the annulus 134, 136, bypassing the packer 304.

Figure 9A:
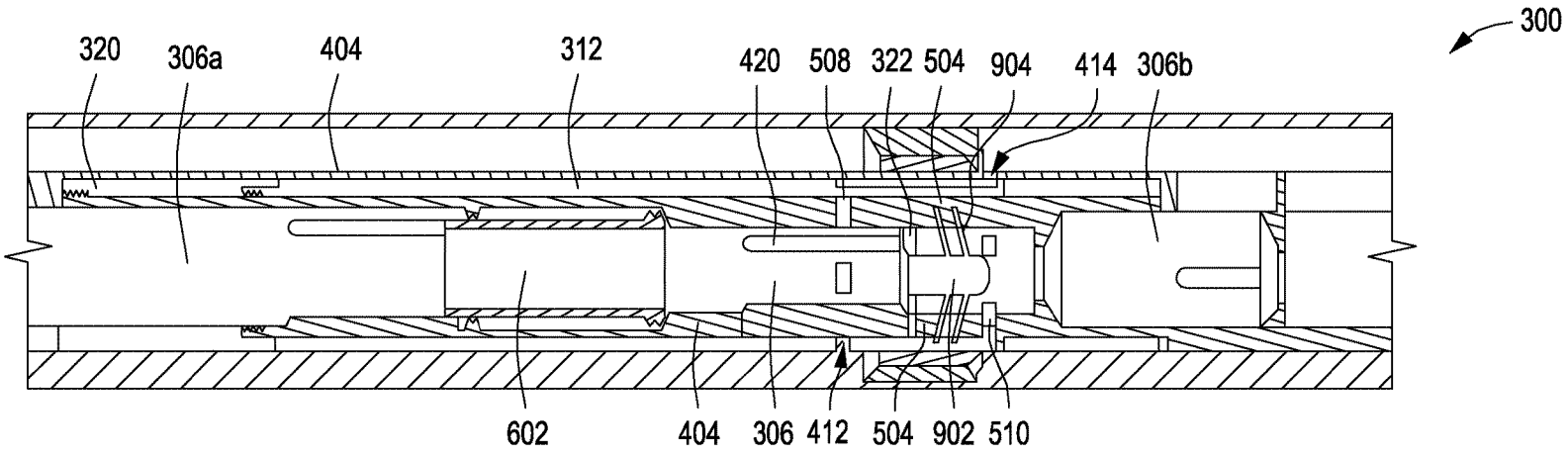
FIG. 9A is a cross-sectional view of the cross-over tool in a reverse circulation mode, in accordance with one or more embodiments.

FIG. 9A illustrates the cross-over tool 300 in a reverse circulation mode. In order to establish reverse circulation, an activation dart 902 is launched into the main tool path 306. The activation dart 902 catches the flow sleeve slider 322 and pulls the flow sleeve slider 322 down, thereby pulling the flow sleeve 312 down to the downhole end of the auxiliary chamber 320, such that the uphole port 412 and downhole port 414 of the outer wall 404 of the tool body 302 are aligned and/or coupled to the partitioned portion 504 of the flow sleeve 312.

The activation dart 902 stops when the flow sleeve slider 322 reaches the end of the flow sleeve slot 420 and remains within the main tool path 306. The activation dart 902 also includes seals 904 which seal the main tool path 306 while the dart 902 is positioned therein. Thus, during the reverse circulation mode, the main tool path 306 is separated into the upper tool path 306*a* and lower tool path 306*b* by the dart 902 and the uphole end 308 separated from the downhole end 310. The uphole ports 508 of the flow sleeve 312 and the uphole ports 412, 416 of the tool body 302 are uphole of the dart 902. The downhole ports 510 of the flow sleeve 312 and the downhole ports 414, 418 of the tool body 302 are downhole of the dart 902. As the flow sleeve 312 is moved towards the downhole end of the auxiliary chamber 320, the hydraulic sleeve 602 is moved downhole as well, into the reverse circulation position, as shown in FIG. 9.

Figure 9B:
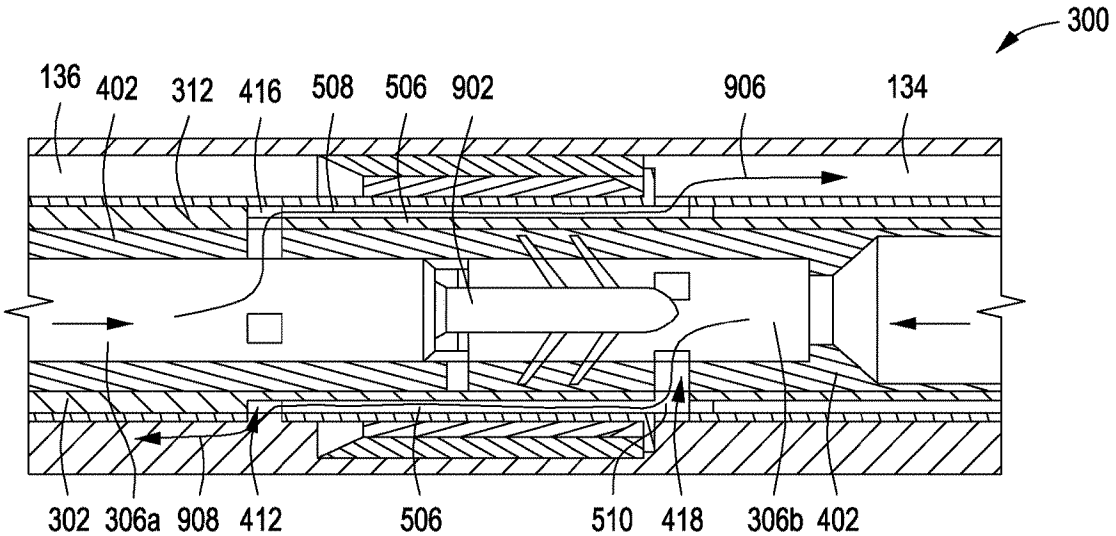
FIG. 9B is a detailed cut-away view of the crossover tool in the reverse circulation mode, showing the flow path through the crossover tool 300, in accordance with one or more embodiments.

FIG. 9B illustrates a detailed partial view of the crossover tool 300 in the reverse circulation mode, illustrating the flow path through the crossover tool 300. When the flow sleeve 312 is moved downward by the dart 902 and into the reverse circulation position, the uphole ports 508 of the flow sleeve are aligned with the uphole tool ports 416 of the inner wall 402 of the tool body 302 and the downhole ports 510 of the flow sleeve 312 are aligned with the downhole tool ports 418 of the inner wall 402 of the tool body 302. As illustrated the FIG. 5, the uphole ports 508 are formed in compartments isolated from the downhole ports 510 when the sleeve is located in the tool body 302. Thus, flow through the uphole ports 508 is isolated from flow through the downhole ports 510.

Arrows 906 indicate the downhole flow path during reverse circulation, and arrows 908 indicate the uphole flow path of returning fluid during reverse circulation. Downhole flow 1002 travels through the upper tool path 306*a* until the dart 902. Flow is then directed into the uphole tool ports 416 of the inner wall 402 of the tool body 302 and into the uphole port 508 of the flow sleeve 312, through the respective compartments 506, and out into the lower annulus 134 through the downhole annulus port 414 of the outer wall 404 of the tool body 302, thus enabling reverse circulation. The uphole flow path 1004 of returning fluid goes towards the surface through the lower tool path 306*b* until flow reaches the dart 902. Flow is then directed into the downhole tool port 418 of the inner wall 402 of the tool body 302 and into the downhole ports 510 of the flow sleeve 312, through the respective compartments 506, and out into the upper annulus 136 through the uphole annulus ports 412 of the outer wall 404 of the tool body 302. The downhole flow path is kept isolated from the uphole flow path and reverse circulation can be performed.

Figure 10A:
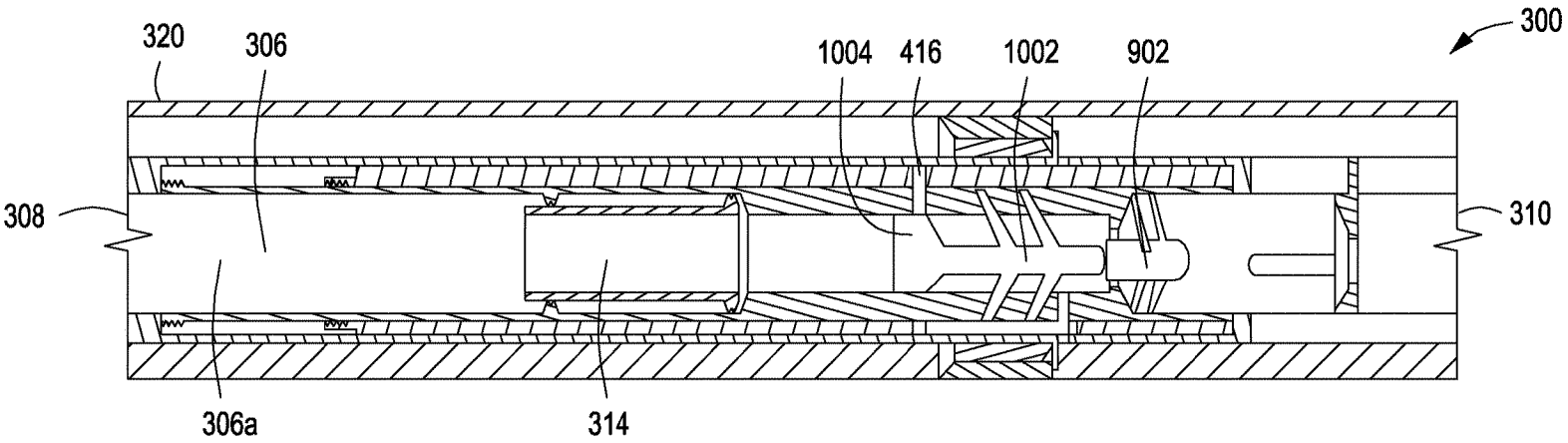
FIG. 10A is a cross-sectional view the cross-over tool being placed back into conventional circulation mode, in accordance with one or more embodiments.
Figure 10B:
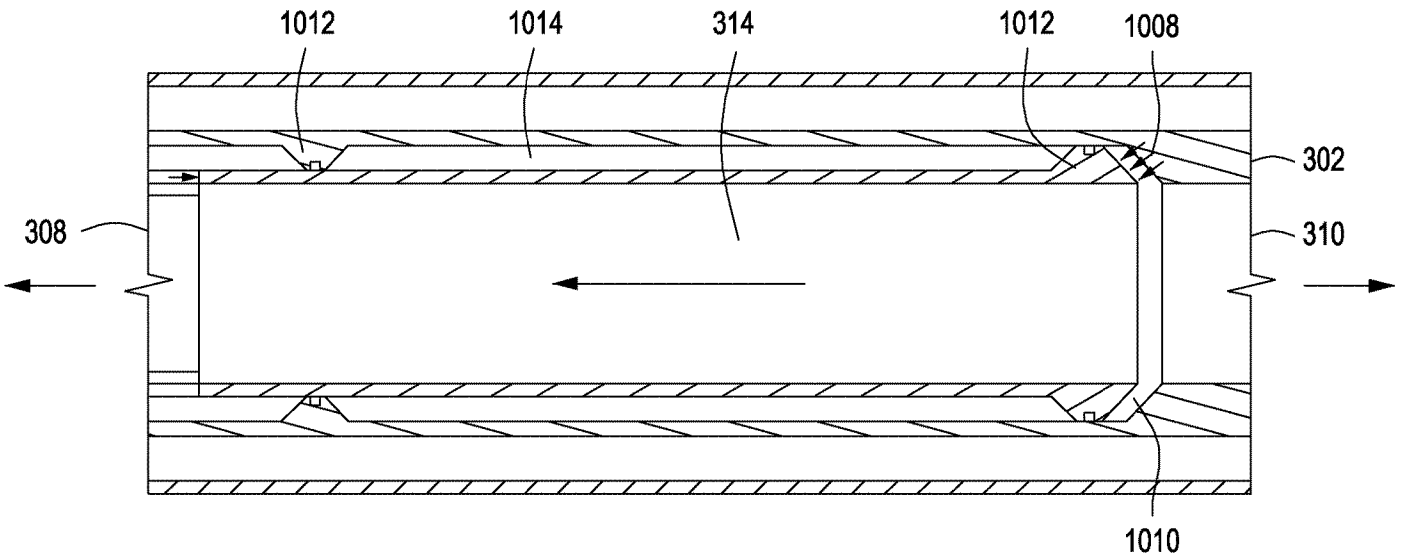
FIG. 10B is a detailed view of a hydraulic sleeve of the cross-over tool, in accordance with one or more embodiments.

FIG. 10A illustrates a step of putting the cross-over tool 300 back into conventional circulation mode. In one or more embodiments, a deactivation dart 1002 is launched into the main tool path 306. The deactivation dart 1002 includes a packer 1004 which blocks the upper tool ports 416. Thus fluid in the upper tool path 306*a* is isolated and pressure builds, acting on the hydraulic sleeve 314. FIG. 10B illustrates a detailed view of the hydraulic sleeve 312 of FIG. 10A. The hydraulic sleeve 312 includes an angled end 1006 which is positioned next to a complementary angled shoulder 1008 of the tool body 302 during the reverse circulation mode. There is a complementary angled gap 1010 between the angled end 1006 of the hydraulic sleeve 312 and the angled shoulder 1008 which gets filled with fluid from the upper tool path 306*a*. Due to the angle of the gap 1010, pressure from fluid flowing into the gap 1010 produces a force applied to the angled end 1006 of the hydraulic sleeve 314, including an upward force vector that pushes the hydraulic sleeve 314 towards the uphole end 308 of the tool 300, thereby placing the hydraulic sleeve 314 in the conventional circulation position. The tool body 302 further includes a stop 1012 positioned uphole of the angled end 1006 of the hydraulic sleeve 314 that stops the hydraulic sleeve 314 from moving any further uphole and/or seals with the hydraulic sleeve 314 to form a chamber 1014 therebetween.

Figure 11:
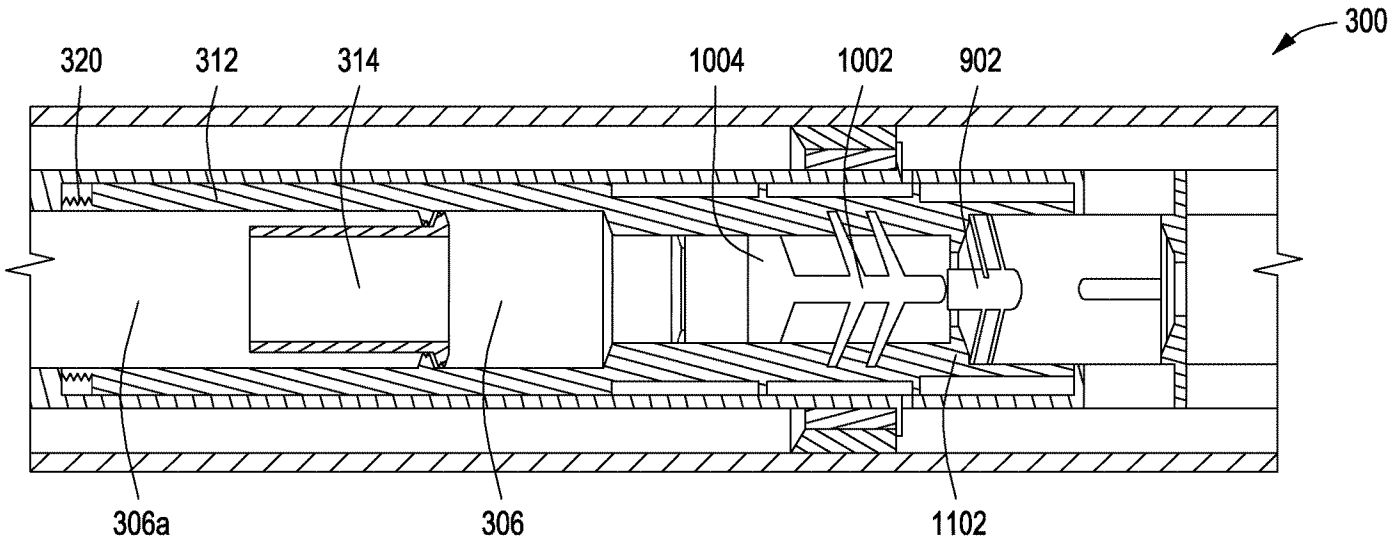
FIG. 11 is a cross-sectional view of the cross-over tool with the hydraulic sleeve in the conventional circulation position, in accordance with one or more embodiments.

FIG. 11 illustrates the crossover tool 300 with the hydraulic sleeve 314 moved all the way uphole into the conventional circulation position. The flow sleeve 312 is thus also moved uphole and into the conventional circulation position in the auxiliary chamber 320. The increased pressure in the upper tool path 306*a* then ejects the darts 1002, 902 from the main flow path 306. In one or more embodiments, the activation dart 902 may shear from a shear ring 1102. The packer 1004 of the deactivation dart 1002 may contract to fit through the various obstacles in the lower tool path. Thus, both darts 1002, 902 are ejected from the main tool path 306, leaving the main tool path 306 open. Thus, with the main tool path 306 open and the flow sleeve moved uphole, the crossover tool 300 is put back into the conventional circulation mode, as illustrated in FIG. 7.

The steps illustrated in FIGS. 9A through 11 can be repeated to switch the cross-over tool 300 between the conventional circulation mode and the reverse circulation mode. In one or more embodiments, every time the cross-over tool 300 is switched into the reverse circulation mode, a shear ring 1102 from an activation dart 902 is added to the flow sleeve slider 322. Thus, in such embodiments, the number of switches permitted during one run of the tool 300 may be limited by the number of shear rings 1102 that can be added to the flow sleeve slider 322.

Figure 12:
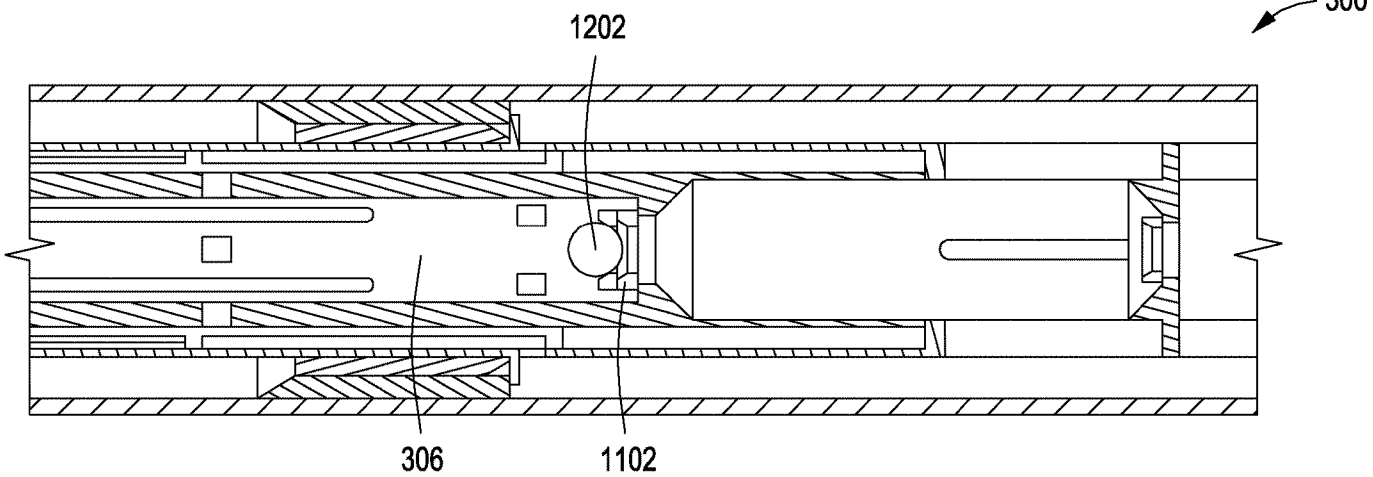
FIG. 12 is cross-sectional view of the cross-over tool facilitating a ball drop to set a liner hanger, in accordance with one or more embodiments.

In one or more applications of the cross-over tool 300, the liner hanger 130 coupled downhole of the cross-over tool 300 may need to be activated after the liner 132 is cemented. In one or more embodiments, a ball drop is required to activate the liner hanger 130. FIG. 12 illustrates such a ball 1202 travelling through the main tool path 306 crossover tool 300. Specifically, the ball 1202 travels past the shear rings 1102 and through the cross-over tool 300 into the liner hanger 130. In one or more embodiments, the shear rings 1102 may be expandable to accommodate the ball 1202.

Figure 13:
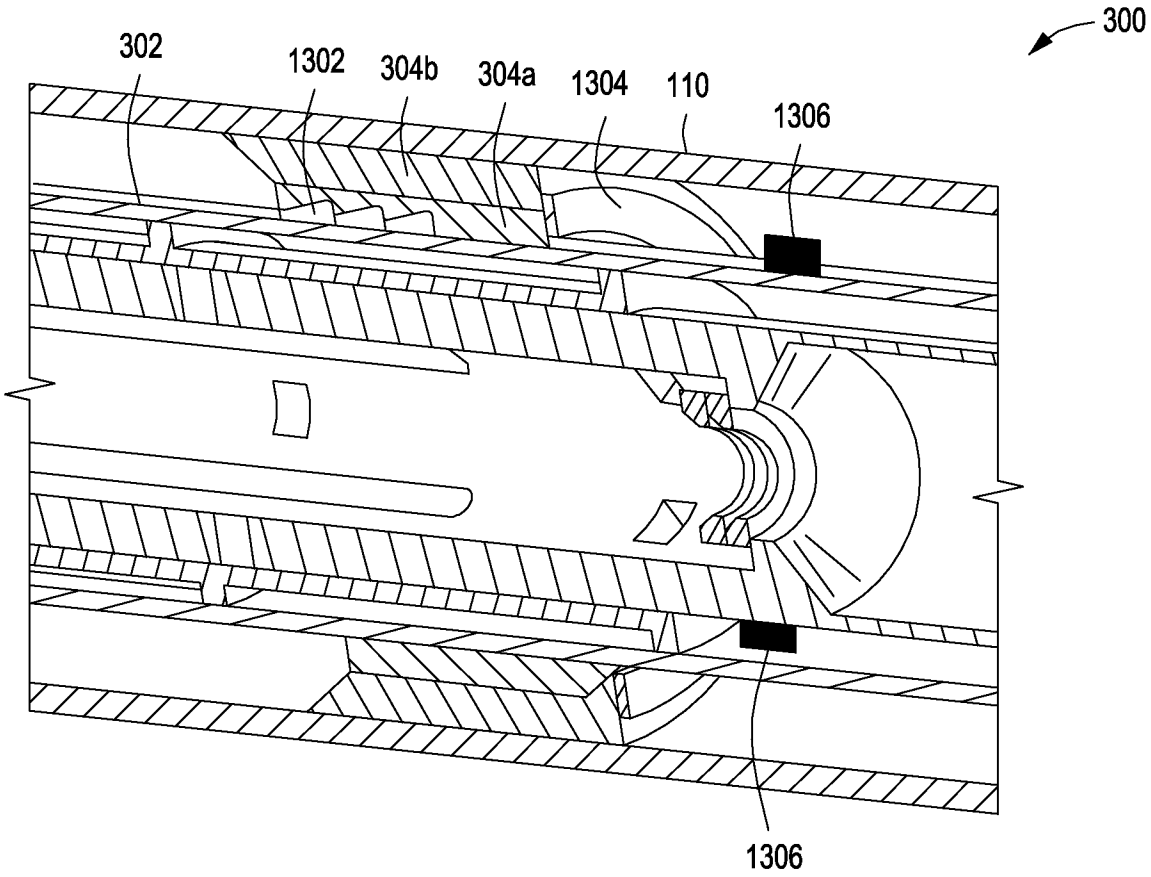
FIG. 13 is a cross-sectional view of the crossover tool illustrating features that facilitate pulling the crossover tool out of hole, in accordance with one or more embodiments.

FIG. 13 illustrates elements of the crossover tool 300 that facilitate pulling the crossover tool 300 out of hole, in accordance with one or more embodiments. When pulling out of hole, the packer sleeve 304*a* is coupled to the tool body 302 via a saw tooth element 1302 and pulled uphole with the tool body 302. However, the packer body 304*b* may retain on the casing wall 110 due to frictional force between the packer body 304*b* and the casing 110. Thus, as the tool body 302 is moved uphole relative to the packer body 304*b*, a block ring 1304 shears from the tool body 302 and the packer sleeve 304*a* is lifted out of the packer body 304*b*. The packer body 304*b* can then collapse and move with respect to the casing 110. The packer body 304*b* and block ring 1304 are then caught by a stopper 1306 on a lower portion of the tool body 302 and lifted uphole with the tool body 302, thereby pulling all crossover tool 300 elements out of hole.

In addition to the embodiments described above, embodiments of the present disclosure further relate to one or more of the following paragraphs:

1. A switchable cross-over device for cementing a wellbore, comprising: a tool body comprising: a main tool path separable into an upper tool path and a lower tool path; and an auxiliary chamber comprising an upper annular port and a lower annular port; a flow sleeve located within the auxiliary chamber; a hydraulic sleeve located within the main tool path and mechanically coupled to the flow sleeve; wherein the flow sleeve is movable into a reverse circulation position by a plug traveling through the main tool path; and wherein the flow sleeve is movable into a conventional circulation position via pressure within the main tool path acting on the hydraulic sleeve.

2. A system for cementing a wellbore, comprising: a conveyance; a casing segment; a switchable crossover tool coupled between the conveyance and a casing segment, the switchable crossover tool comprising: a tool body comprising: a main tool path separable into an upper tool path and a lower tool path; and an auxiliary chamber comprising an upper annular port and a lower annular port; a flow sleeve located within the auxiliary chamber; a hydraulic sleeve located within the main tool path and mechanically coupled to the flow sleeve, wherein the flow sleeve is movable into a reverse circulation position by a plug traveling through the main tool path and movable into a conventional circulation position via pressure within the main tool path acting on the hydraulic sleeve; and an annular packer located on the outside of the tool body separating an annulus between the switchable crossover tool and the well into an upper annulus and a lower annulus.

3. A method of cementing a casing in a wellbore having a wall, comprising: setting a packer in an annulus between a cross-over tool and the wellbore wall, wherein the packer separates the annulus into a lower annulus and an upper annulus; placing a plug within a main flow path of the cross-over tool, separating the main tool path into an upper tool path and a lower tool path; moving a flow sleeve of the cross-over tool in a first axial direction into a reverse circulation position, placing the upper tool path in fluid communication with the lower annulus and placing the lower tool path in fluid communication with the upper annulus; and moving a hydraulic sleeve located within the main flow path in the first axial direction, wherein the hydraulic sleeve is mechanically coupled to the flow sleeve.

4. The method of paragraph 3, further comprising isolating the upper tool path and generating a hydraulic pressure in the upper tool path.

5. The method of either paragraph 3 or 4, further comprising applying the hydraulic pressure onto the hydraulic sleeve to move the hydraulic sleeve and flow sleeve in a second axial direction opposite of the first axial direction.

6. The method according to any one of paragraphs 3-5, wherein isolating the upper tool path comprises placing a plug in the upper tool path to seal the upper tool path from the lower annulus.

7. The method according to any one of paragraphs 3-6, further comprising moving the flow sleeve into the reverse circulation position via a dart traveling through the main tool path in the first axial direction, the dart pushing the flow sleeve via a flow sleeve shoulder.

8. The method according to any one of paragraphs 3-7, wherein the dart comprises the plug.

9. The method according to any one of paragraphs 3-8, further comprising cementing the casing in the wellbore.

10. The device, the system, or the method of any one of paragraphs 1-9, wherein in the conventional circulation position, the upper tool path and the lower tool path are in fluid communication, and the upper annular port is in fluid communication with the lower annular port through the auxiliary chamber.

11. The device, the system, or the method of any one of paragraphs 1-10, wherein in the reverse circulation position, the upper tool path is separated from the lower tool path, and the flow sleeve forms a first auxiliary flow path and a second auxiliary flow path in the auxiliary chamber, wherein the first auxiliary flow path provides fluid communication between the upper tool path and the lower annular port, and the second auxiliary flow path provides fluid communication between the lower tool path and the upper annular port.

12. The device, the system, or the method of any one of paragraphs 1-11, wherein the upper tool path is separable from the lower tool path by the plug located within the main tool path.

13. The device, the system, or the method of any one of paragraphs 1-12, wherein the plug is configured to move the flow sleeve in a downhole direction to place the flow sleeve in the reverse circulation position, and wherein hydraulic pressure in the main flow bore pushes the hydraulic sleeve in an uphole direction, thereby pushing the flow sleeve uphole as well and into the conventional circulation position.

14. The device, the system, or the method of any one of paragraphs 1-13, wherein a second plug is locatable in the main flow path and isolates the upper tool path, thereby generating the hydraulic pressure.

15. The device, the system, or the method of any one of paragraphs 1-14, wherein the hydraulic pressure acts on a chamfered end of the hydraulic sleeve.

16. The device, the system, or the method of any one of paragraphs 1-15, further comprising packer coupled to an outside surface of the tool body and configured to be actuated by a packer dart.

17. The device, the system, or the method of any one of paragraphs 1-16, wherein in the conventional circulation position, the conveyance is in fluid communication with the casing segment through the main flow path and the lower annulus is in fluid communication with an upper annulus through the auxiliary chamber.

18. The device, the system, or the method of any one of paragraphs 1-17, wherein in the reverse circulation position, the main tool path is separated into an upper tool path and a lower tool path, and wherein the conveyance is in fluid communication with the lower annulus through the upper tool path and the casing segment is in fluid communication with the upper annulus the lower tool path.

19. The device, the system, or the method of any one of paragraphs 1-18, wherein the plug pulls the flow sleeve in a downhole direction to place the flow sleeve in the reverse circulation position, and wherein hydraulic pressure in the main flow bore pushes the hydraulic sleeve in an uphole direction, thereby pushing the flow sleeve uphole as well and into the conventional circulation position.

20. The device, the system, or the method of any one of paragraphs 1-19, wherein a second plug is located in the main flow path and isolates the upper tool path, thereby generating the hydraulic pressure.

21. The device, the system, or the method of any one of paragraphs 1-10, wherein the hydraulic pressure acts on the hydraulic sleeve.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A switchable cross-over device for cementing a wellbore, comprising:

a tool body comprising:

a main tool path separable into an upper tool path and a lower tool path; and an auxiliary chamber comprising an upper annular port and a lower annular port;

a flow sleeve located within the auxiliary chamber;

a hydraulic sleeve located within the main tool path and mechanically coupled to the flow sleeve;

wherein the flow sleeve is movable into a reverse circulation position by a plug traveling through the main tool path, wherein in the reverse circulation position, the upper tool path is separated from the lower tool path, and the flow sleeve forms a first auxiliary flow path and a second auxiliary flow path in the auxiliary chamber, wherein the first auxiliary flow path extends between the upper tool path and the lower annular port, and the second auxiliary flow path extends between the lower tool path and the upper annular port; and wherein the flow sleeve is movable into a conventional circulation position via pressure within the main tool path acting on the hydraulic sleeve, wherein in the conventional circulation position, a third auxiliary flow path extends between the upper tool path and the lower tool path, and a fourth auxiliary flow path extends between the upper annular port and the lower annular port through the auxiliary chamber.

2. The device of claim 1, wherein the upper tool path is separable from the lower tool path by the plug located within the main tool path.

3. The device of claim 1, wherein the plug is configured to move the flow sleeve in a downhole direction to place the flow sleeve in the reverse circulation position, and wherein hydraulic pressure in the main flow bore pushes the hydraulic sleeve in an uphole direction, thereby pushing the flow sleeve uphole as well and into the conventional circulation position.

4. The device of claim 3, wherein a second plug is locatable in the main flow path and isolates the upper tool path, thereby generating the hydraulic pressure.

5. The device of claim 3, wherein the hydraulic pressure acts on a chamfered end of the hydraulic sleeve.

6. The device of claim 1, further comprising packer coupled to an outside surface of the tool body and configured to be actuated by a packer dart.

7. A system for cementing a wellbore, comprising:

a conveyance;

a casing segment;

a switchable crossover tool coupled between the conveyance and a casing segment, the switchable crossover tool comprising:

a tool body comprising:

a main tool path separable into an upper tool path and a lower tool path; and an auxiliary chamber comprising an upper annular port and a lower annular port;

a flow sleeve located within the auxiliary chamber; and a hydraulic sleeve located within the main tool path and mechanically coupled to the flow sleeve, wherein the flow sleeve is movable into a reverse circulation position by a plug traveling through the main tool path and movable into a conventional circulation position via pressure within the main tool path acting on the hydraulic sleeve;

an annular packer located on the outside of the tool body separating an annulus between the switchable crossover tool and the well into an upper annulus and a lower annulus;

wherein in the conventional circulation position, the conveyance is in fluid communication with the casing segment through a first flow path extending between the upper tool path and the lower tool path, and the lower annulus is in fluid communication with an upper annulus through a second flow path extending between the upper annular port and the lower annular port; and wherein in the reverse circulation position, the conveyance is in fluid communication with the lower annulus through a third flow path formed between the upper tool path and the lower annular port, and the casing segment is in fluid communication with the upper annulus through a fourth flow path extending between the upper annular port and the lower tool path.

8. The system of claim 7, wherein the plug pulls the flow sleeve in a downhole direction to place the flow sleeve in the reverse circulation position, and wherein hydraulic pressure in the main flow bore pushes the hydraulic sleeve in an uphole direction, thereby pushing the flow sleeve uphole as well and into the conventional circulation position.

9. The system of claim 8, wherein a second plug is located in the main flow path and isolates the upper tool path, thereby generating the hydraulic pressure.

10. The system of claim 9, wherein the hydraulic pressure acts on the hydraulic sleeve.

11. A method of cementing a casing in a wellbore having a wall, comprising:

setting a packer in an annulus between a cross-over tool and the wellbore wall, wherein the packer separates the annulus into a lower annulus and an upper annulus;

placing a plug within a main flow path of the cross-over tool, separating the main tool path into an upper tool path and a lower tool path;

moving a flow sleeve of the cross-over tool in a first axial direction into a conventional circulation position, creating a first flow path between the upper tool path and the lower tool path and creating a second flow path between the lower annulus and the upper annulus;

moving a hydraulic sleeve located within the main flow path in the first axial direction, wherein the hydraulic sleeve is mechanically coupled to the flow sleeve; and moving the flow sleeve into the reverse circulation position via a dart traveling through the main tool path in the first axial direction, the dart pushing the flow sleeve via a flow sleeve shoulder, creating a third flow path between the upper tool path and the lower tool path, and creating a fourth flow path between the lower annulus and the upper annulus.

12. The method of claim 11, further comprising isolating the upper tool path and generating a hydraulic pressure in the upper tool path.

13. The method of claim 12, further comprising applying the hydraulic pressure onto the hydraulic sleeve to move the hydraulic sleeve and flow sleeve in a second axial direction opposite of the first axial direction.

14. The method of claim 12, wherein isolating the upper tool path comprises placing a plug in the upper tool path to seal the upper tool path from the lower annulus.

15. The method of claim 11, wherein the dart comprises the plug.

16. The method of claim 11, further comprising cementing the casing in the wellbore.

* * * * *